US007248807B2

(12) United States Patent
Oka et al.

(10) Patent No.: US 7,248,807 B2
(45) Date of Patent: Jul. 24, 2007

(54) FIXING DEVICE

(75) Inventors: Kanji Oka, Kanagawa (JP); Takashi Ohhashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 87 days.

(21) Appl. No.: 11/063,989

(22) Filed: Feb. 24, 2005

(65) Prior Publication Data

US 2006/0056866 A1 Mar. 16, 2006

(30) Foreign Application Priority Data

Sep. 10, 2004 (JP) ..... 2004-263458

(51) Int. Cl.
*G03G 15/20* (2006.01)

(52) U.S. Cl. ..... 399/33; 399/69; 399/70

(58) Field of Classification Search ..... 219/216; 399/33, 44, 69, 70, 328, 334
See application file for complete search history.

(56) References Cited

U.S. PATENT DOCUMENTS 5,987,275 A * 11/1999 Toyohara et al. ..... 399/70

FOREIGN PATENT DOCUMENTS

JP 11-242405 A 9/1999

* cited by examiner

*Primary Examiner*—Hoang Ngo
(74) *Attorney, Agent, or Firm*—Morgan, Lewis & Bockius LLP

(57) ABSTRACT

A fixing device includes a heater; a fixing rotary body having a circumferential surface which paper carrying an unfixed image makes contacts with and passes on, and heated to a predetermined temperature by a heating operation of the heater; a temperature detecting unit which detects the temperature of a portion of the circumferential surface inside a widest paper passage region in an axial direction of the fixing rotary body; a control unit which stops the heating operation of the heater when a temperature detected by the temperature detecting unit exceeds a predetermined overheat temperature; and a measuring unit which measures a continuous heating time from a point of time when the heating operation of the heater starts. The control unit stops the heating operation of the heater when the continuous heating time measured by the measuring unit exceeds a predetermined scheduled heating time.

4 Claims, 5 Drawing Sheets

FIXING DEVICE

BACKGROUND OF THE INVENTION

1. Field of the Invention

The present invention relates to a fixing device which performs fixing by passing paper carrying an unfixed image on a fixing rotary body in contact therewith, and more specifically, to a fixing device with a function to prevent overheat a fixing rotary body when paper is wound around the fixing rotary body.

2. Description of the Related Art

Generally, in image forming apparatuses, such as printers, copying machines, facsimiles or compound machines, in which an image is formed on paper with (dry) toner by using an image forming method, such as an electro-photographic method, an electrostatic recording method, etc., fixing devices are used for fixing an unfixed toner image (unfixed images) transferred onto the paper.

As such fixing devices, for example, a fixing device comprising a fixing roller which is heated to a predetermined temperature by a heater and rotated, and a pressure roller which is pressure-contacted with the fixing roller to form a fixing nip and rotated is known. Paper having an unfixed toner image transferred thereto is introduced into and passes through the fixing nip that is a pressure-contact region between the fixing roller and the pressure roller, and the toner in the unfixed image is heated and melted and simultaneously an image receiving surface of the paper is pressurized, so that a toner image is fixed on the paper.

Further, this type of fixing device is usually configured such that a temperature sensor detects the temperature of a circumferential surface of the fixing roller, and the control which turns on or off the heating operation of a heater is performed according to the temperature detected, thereby heating the fixing roller to a predetermined temperature. Moreover, if a temperature detected by the temperature sensor or a separate temperature sensor is an abnormal high temperature, the heating operation is stopped.

Meanwhile, in such a fixing device, a situation sometime occurs that the paper which has passed through the fixing nip is not peeled from the circumferential surface of the fixing roller, but is wound around as it is. This may result in an overheated state of the fixing roller due to excessive heating thereof by the heater.

In particular, when the temperature sensor is disposed in contact with the circumferential surface of the fixing roller (for example, a region in the vicinity of a central portion in the axial direction) inside its paper passage region, the temperature sensor detects the temperature of the fixing roller via the wound paper. Therefore, the temperature of the fixing roller cannot be accurately detected. In other words, it is often that an actual temperature of the fixing roller around which paper is wound is erroneously detected as a temperature lower than itself. As a result, the above-mentioned control which stops the heating operation of the heater cannot be appropriately performed. For this reason, the fixing roller becomes overheated, which results in damage to a resin layer, etc formed on its surface. Moreover, problems occur including causing deterioration of the quality of a fixed image, etc.

With respect to the above problem, for the purpose of preventing occurrence of the problem caused by winding of paper around the fixing roller, a fixing device is conventionally suggested in which a temperature detecting unit is disposed to contact a region of the fixing roller outside its paper passage region, and when the temperature detected by the temperature detecting unit exceeds a predetermined overheat temperature, an overheat preventing unit is provided for intercepting the power supply to a heater (See JP-A-11-242405).

However, the fixing device related to the above suggestion also has the following problems.

First, since the temperature detecting unit is disposed outside the widest paper passage region of the fixing roller, in order to accurately detect an abnormal overheat temperature in case paper with the largest width is wound around the fixing roller, it is necessary to further extend and dispose a heat generating portion of the heater by such an extra amount that a region heated by the heater extends to a region outside the widest paper passage region. It may deteriorate the density of thermal energy, which makes it impossible to efficiently heat the fixing roller by using the thermal energy.

Further, in the fixing device in which the fixing roller is heated by a plurality of independently controllable heaters, the temperature detecting unit should be respectively installed in conformity with the heating regions of the respective heaters. Therefore, the number of temperature detecting unit to be installed may increase with an increase in the number of heaters to be installed, which may increase the cost.

SUMMARY OF THE INVENTION

The present invention has been made in view of the above circumstances and provide a fixing device capable of more appropriately preventing overheat of a fixing rotary body when paper is wound around the fixing rotary body, without causing a decrease in the heating efficiency within a paper passage region and an increase in cost.

According to a first aspect of the invention, a fixing device includes a heater; a fixing rotary body having a circumferential surface which paper carrying an unfixed image makes contacts with and passes on, and heated to a predetermined temperature by a heating operation of the heater; a temperature detecting unit which detects the temperature of a portion of the circumferential surface inside a widest paper passage region in an axial direction of the fixing rotary body; a control unit which stops the heating operation of the heater when a temperature detected by the temperature detecting unit exceeds a predetermined overheat temperature; and a measuring unit which measures a continuous heating time from a point of time when the heating operation of the heater starts. The control unit stops the heating operation of the heater even when the continuous heating time measured by the measuring unit exceeds a predetermined scheduled heating time.

DETAILED DESCRIPTION OF THE PREFFERED EMBODIMETNS

Figure 1:
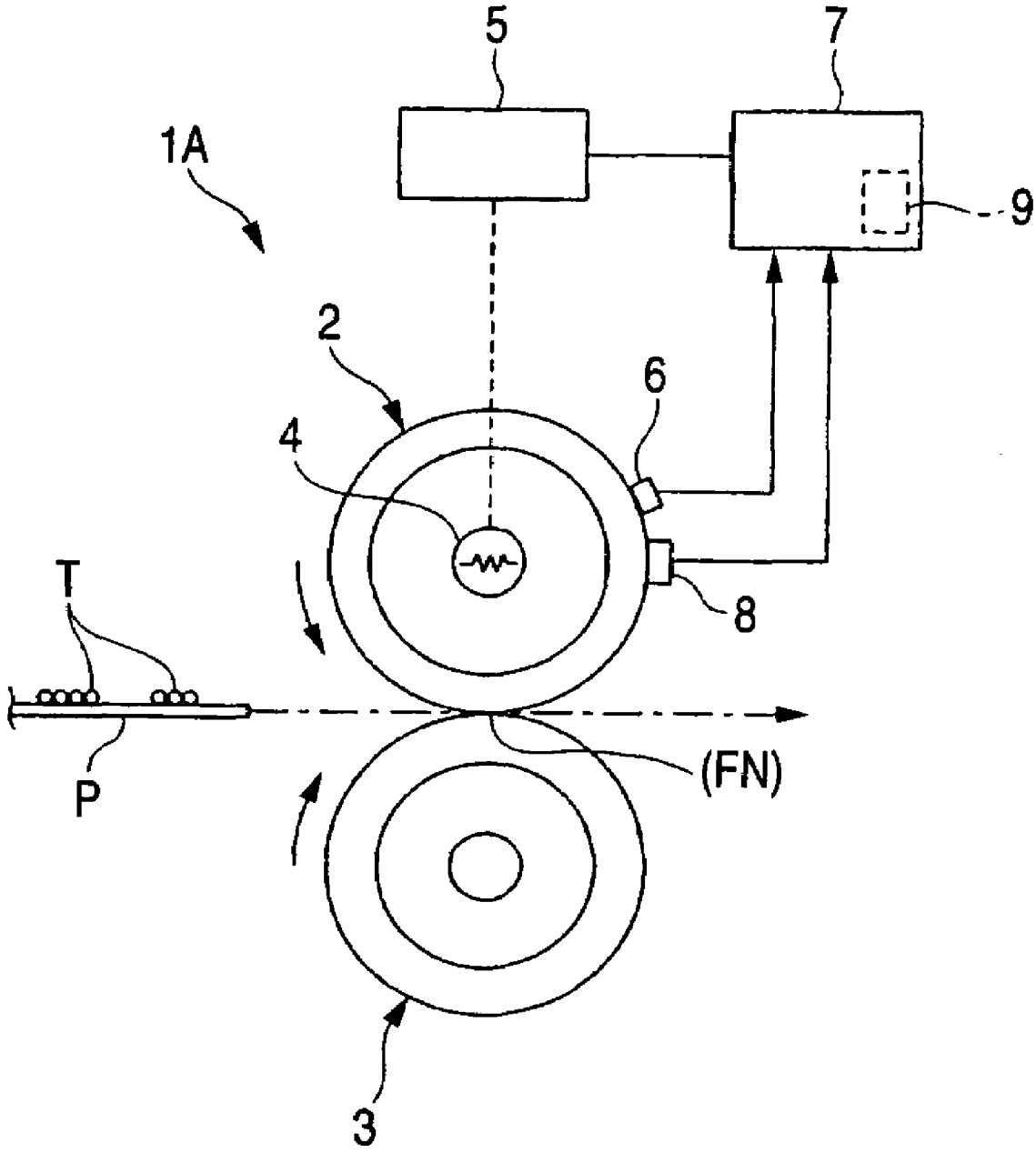
FIG. 1 is a schematic view showing principal parts of a fixing device according to Embodiment 1 of the present invention.

While the invention has been described in detail and with reference to specific embodiments thereof, it will be apparent to one skilled in the art that various changes and modifications can be made without departing from the scope thereof.

This application is based on Japanese patent application No. 2004-263458 filed on Feb. 25, 2005, the entire contents thereof being hereby incorporated by reference.

A fixing device of the present invention includes: a heater, a fixing rotary body having a circumferential surface which paper carrying an unfixed image makes contacts with and passes on, and heated to a predetermined temperature by the heating operation of the heater; a temperature detecting unit which detects the temperature of a portion of the circumferential surface inside a widest paper passage region in an axial direction of the fixing rotary body; a control unit which stops the heating operation of the heater when a temperature detected by the temperature detecting unit exceeds a predetermined overheat temperature; and a measuring unit which measures a continuous heating time from a point of time when the heating operation of the heater starts, in which the control unit stops the heating operation of the heater even when the continuous heating time measured by the measuring unit exceeds a predetermined scheduled heating time.

In the fixing device, the temperature detecting unit may be disposed to detect the temperature of a portion of the circumferential surface outside a paper passage region which is narrower than the widest paper passage region.

Further, in the fixing device, the fixing device further includes a plurality of the heaters having different widths of heating serving regions within the widest paper passage region and having their heating operation independently controlled, in which the temperature detecting unit is disposed to detect the temperature of the circumferential surface of a heating serving region including an end of the heater which heats a region of the widest paper passage region at its endmost side.

Moreover, in the fixing device, the control unit may employ a required warm-up time as the scheduled heating time when the heating operation of the heater is an operation during warm-up, and may employ a required standby time as the scheduled heating time when the heating operation of the heater is an operation during the standby. Here, the expression "during warm-up" is an operation period during which the fixing roller is heated until its temperature becomes a temperature at which fixing can be performed. The expression "during standby" is an operation period during which the fixing roller is preliminarily heated to a little lower temperature during standby that the fixing operation is not executed for a while.

According to the present invention, when paper is wound around a fixing rotary body, a temperature detecting unit detects the temperature of the fixing rotary body via the paper. In such a case, even when the temperature detecting unit performs temperature detection that does not exceed a predetermined overheat temperature, a measuring unit measures a continuous heating time from a point of time when the heating operation of a heater starts. If the measured continuous heating time exceeds a predetermined scheduled heating time, the control unit stops the heating operation of the heater.

Further, in the fixing device, the temperature detecting unit is disposed inside a paper passage region of the fixing rotary body. Thus, a heat generating portion of the heater need not be extended to the outside of the paper passage region, and can be disposed only inside the paper passage region. Therefore, as for the widest paper passage region, heat distribution with no waste can be performed. Moreover, even when a plurality of heaters is installed, temperature detecting unit need not be installed by the number corresponding to the number of the heaters installed.

Accordingly, in the fixing device, the overheat of a fixing rotary body when paper is wound around the fixing rotary body can be more appropriately prevented without causing a decrease in the heating efficiency of a paper passage region and an increase in cost Further, in the fixing device which also has a function of stopping the heating operation if such continuous heating time exceeds a predetermined value, a fixing rotary body having disadvantageous characteristics, in particular, for the detection of the temperature detecting unit, that is, a fixing rotary body (for example, a fixing rotary body having a characteristic with a thermal conductivity of less than 200 W/m (m·k) at 300K) made of a material (such as iron) with small thermal transfer in the direction of a rotation axis, or a fixing rotary body having a low thermal storage efficiency (for example, a fixing rotary body having a thickness of less than 1 mm in a thinnest region of the paper passage region) can be used as the rotary fixing body. As a result, it is advantageous because the above-mentioned fixing rotary bodies can be applied to a so-called instant fixing device (for example, a fixing device, with an energy-saving performance, which is configured for the purposes of reducing thermal energy required for heating the fixing rotary body).

Further, when the temperature detecting unit is disposed to detect the temperature of a portion of the circumferential surface outside a paper passage region which is the next widest region to the widest paper passage region, and when paper having width enough to pass through the next widest paper passage region is wound around the fixing rotary body, the temperature detecting unit can directly detect, as usual, the temperature of a circumferential surface of a fixing rotary body with no wound paper. As a result, the detected temperature exceeds the overheat temperature, thereby stopping the heating operation of the heater. Therefore, the overheat of the fixing rotary body can be appropriately prevented.

Further, as for the heater, if the fixing device further comprises a plurality of the heaters having different widths of heating serving regions within the widest paper passage region and having their heating operation independently controlled, in which the temperature detecting unit is disposed to detect the temperature of the circumferential surface within a heating serving region including an end of the heater of the plurality of heaters which heats a region of the widest paper passage region at its endmost side, the following effects can be obtained.

That is, when paper passing through a heating region of a heater for heating a paper passage region which does not include a farthest end of the widest paper passage region in which the temperature detecting unit is installed is wound around the fixing rotary body, in a region where the temperature detecting unit is installed, there also exists an operation pattern in which a heater serving to heat the region only when wound paper does not exist, does not performs heating operation. Therefore, there is a case in which the temperature detected by the temperature detecting unit does not exceed an overheat temperature. However, even in this case, the continuous heating time of the heater serving to heat the region exceeds a predetermined scheduled heating time, thereby stopping the heating operation of the heater. Therefore, the overheat of the fixing rotary body can be appropriately prevented.

Moreover, as for the control unit, when the control unit employs a required warm-up time as the scheduled heating time when the heating operation of the heater is an operation during warm-up, and employs a required standby time as the scheduled heating time when the heating operation of the heater is an operation during the standby, scheduled heating times (required warm-up time or required standby time) appropriately corresponding to the differences between levels of the heating operation of the heater, etc. are selected and applied. Therefore, controls (stopping of the heating operation) respectively corresponding to the scheduled heating times are performed, which also makes it possible to appropriately prevent overheat of the fixing rotary body.

Embodiment 1

Figure 2:
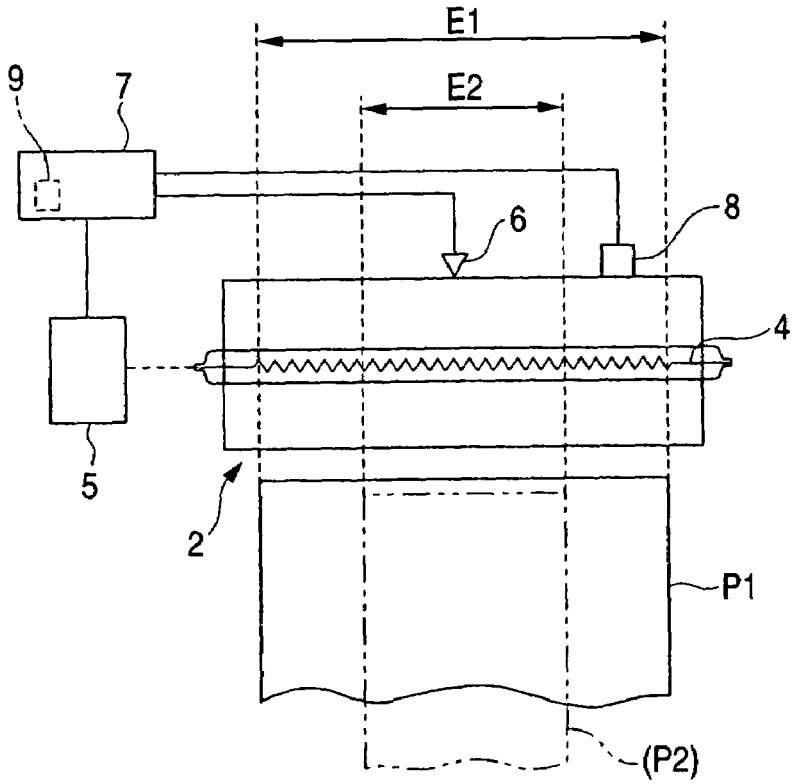
FIG. 2 is an explanatory view showing a construction of a part of the fixing device in FIG. 1.

FIGS. 1 and 2 show principal parts of a fixing device according to Embodiment 1 to which the present invention is applied, in which FIG. 1 is a schematic view of the fixing device as seen from the front side, and FIG. 2 is an explanatory view of a part of the fixing device.

As shown in FIG. 1, the fixing device 1A mainly comprises a cylindrical fixing roller 2 which is installed to be rotationally driven in a predetermined direction; a cylindrical pressure roller 3 which is installed to be pressure-contacted with the fixing roller 2 to form a fixing nip FN; an electro-thermal heat generation type heater 4 which is disposed in a cylindrical hollow portion of the fixing roller 2 to heat the roller; a power unit 5 which supplies the heater 4 with power for heating; a contact-type temperature sensor 6 which detects the temperature of a circumferential surface of the fixing roller 2; and a control device 7 which control the operation of the overall fixing device 1A, and is configured to introduce paper P carrying an unfixed toner image T into the fixing nip FN to be passed therethrough. The one-dot chain line with an arrow in the drawing indicates a regular conveying path of the paper P.

Basically, the fixing roller 2 is a metallic roller which is made of a metallic material such as aluminum or iron and formed in a cylindrical shape, and if necessary, is obtained by laminating a releasing layer on its roller surface. Further, the fixing roller 2 is configured to receive power from a driving device (reference numeral 10, see FIG. 3) composed of a drive motor, a rotation transmission mechanism, etc., and to be rotationally driven in the direction of the arrow. In particular, as the metallic roller (core) of the fixing roller 2, a roller having an axially low thermal conductivity (a roller having a thermal conductivity of less than 200 W/(m·k) at 300K), and a roller (an iron roller) having a lower thermal storage efficiency can be used, if necessary. The pressure roller 3 is a roller which is made of a metallic material such as stainless, and formed in a columnar shape, and if necessary is obtained by laminating an elastic layer, a releasing layer, etc. on its roller surface. The pressure roller 3 is urged against the fixing roller 2 with a predetermined pressure by a pressing mechanism (not shown) via its rotating shaft.

As shown in FIG. 2, the heater 4 is an electro-thermal heat generation type heater (specifically, for example, a halogen lamp) which has a heat generating portion which can heat a region (a widest paper passage region) which paper P1 having the largest width in an axial direction of the fixing roller 2 makes contacts with and passes on. The heater 4 is supplied with predetermined electric power from the power unit 5 to thereby heat the fixing roller 2 from its hollow interior.

The temperature sensor 6 is a sensor used for control which heats and maintains the fixing roller 2 in a predetermined range of temperature (mainly, fixing temperature) by the heating operation of the heater 4. In this embodiment, the temperature sensor 6 is disposed in contact with the circumferential surface of the fixing roller 2 substantially at a central portion of the widest paper passage region E1 in the direction of the rotation axis of the fixing roller 2. The central portion is, for example, a region on which all sizes of paper passes on when a so-called 'center registration conveyance' is performed in which paper is conveyed on the basis of the centerline of the paper conveying path. The temperature sensor 6 is connected to the control device 7 to transmit its detected information to the control device.

Figure 3:
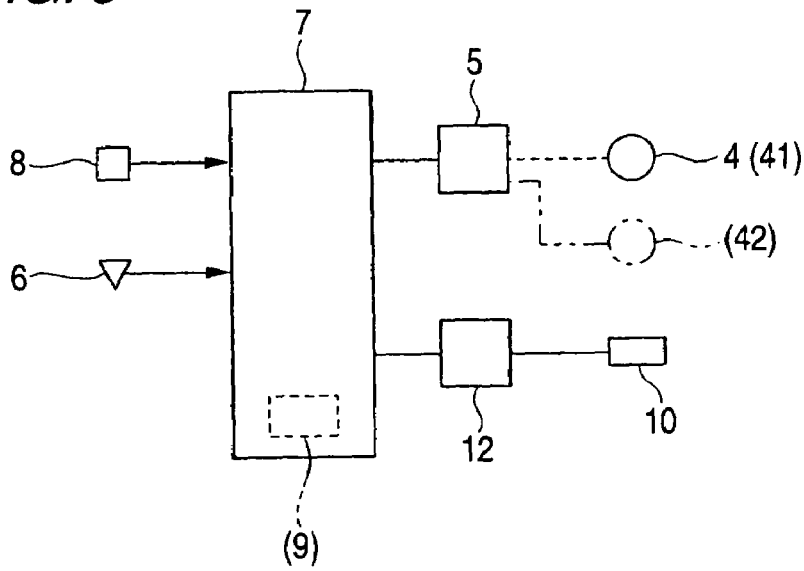
FIG. 3 is a block diagram showing a construction of a main control system of the fixing device in FIG. 1.

The control device 7 includes a microcomputer etc. composed of an operation processing unit, a storage unit, and the like. A necessary control program, data and the like are stored in the storage unit. As shown in FIG. 3 etc., to the control device 7 is input the detected information (signals) output from the temperature sensor 6 as described above, and necessary information signals (power ON/OFF signals, start and completion signals on the image forming operation, identification signals on the size and type of paper P to be used, etc.) on the image forming operation etc. from the main body side of the image forming apparatus which utilizes the fixing device.

Further, the control device 7 is connected to the power unit (or a control unit thereof) 5 and a control unit 12 which controls the driving device 10, and so on. This allows the control device 7 to control the operation that the power unit 5 supplies the heater 4 with power on the basis of the information input from the temperature sensor 6 etc., or to control the driving operation of the driving device 10 on the basis of predetermined information signals. In particular, the control of the power supply operation of the power unit 5 is performed on the basis of the temperature information detected by the temperature sensor 6. For example, during fixing operation, the control device 7 performs control that, if a detected temperature a little exceeds the upper limit of a fixing temperature (range), the power supply operation stops, and if the detected temperature becomes a little less than the lower limit of the fixing temperature, the power supply operation resumes.

As shown in FIGS. 1 and 2, the fixing device 1A is equipped with a second temperature sensor 8 which detect the temperature of a portion of the circumferential surface of the fixing roll 2 inside the paper passage region E1 having the largest width in the axial direction of the fixing roller. The fixing device 1A is also provided with a timer counter 9 which counts the time (continuous heating time) which is taken while the heating operation is continuously performed from a point of time when the heating operation of the heater 4 starts.

The second temperature sensor 8 is a contact-type temperature sensor, similar to the temperature sensor 6, which is disposed to detect the temperature of a portion (a region excluding the region E2 from the region E1) of the circumferential surface of the fixing roller 2 outside a paper passage region E2 which is the next widest region to the widest paper passage region E1. The timer counter 9 is configured to be provided in the control device 7, but may be configured as a counter which is provided separately from the control device 7.

Moreover, as shown in FIGS. 1 to 3, in the fixing device 1A, the control device 7 has the second temperature sensor 8 connected thereto, and has the timer counter 9. Also, the control device 7 is configured to perform a control operation which stops the heating operation of the heater 4 when the temperature (H) detected by the second temperature sensor 8 exceeds a predetermined overheat temperature ($H_X$), and to perform a control operation which stops the heating operation of the heater 4 even when the continuous heating time (T) counted by the timer counter 9 exceeds a predetermined scheduled heating time ($T_X$). Incidentally, the former control operation by the control device 7 can be performed using detected information by the temperature sensor 8.

Figure 4:
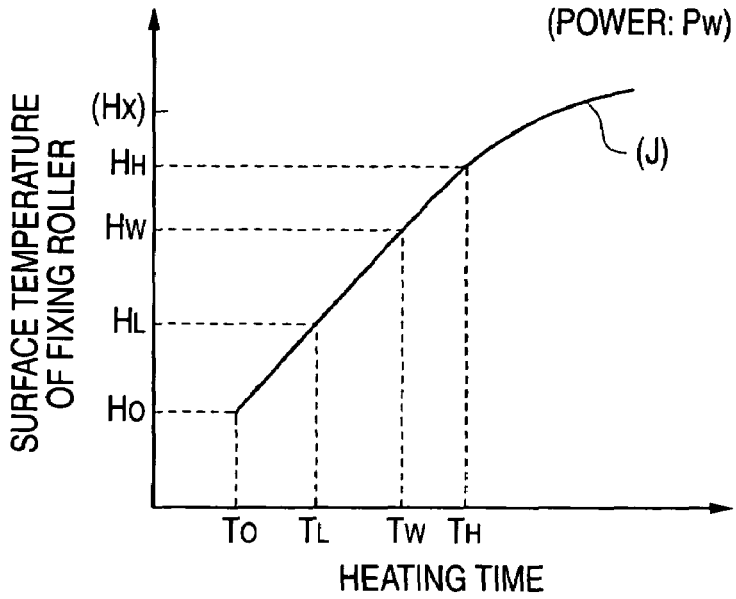
FIG. 4 is a drawing for explaining the relationship between heating characteristics of a heater with respect to the fixing roller and setting of estimated (required) heating time.

It is noted herein that, as shown in FIG. 4, the predetermined overheat temperature ($H_X$) is, for example, a temperature which is higher than an upper limit ($H_H$) of the fixing temperature (a temperature range of between a lower limit $H_L$ and the upper limit $H_H$), and a temperature immediately before (a little lower than) a temperature at which the fixing device 2 is overheated.

Further, as shown in FIG. 4, the predetermined scheduled heating time ($T_X$) is set, for example, by preparing a heating characteristic curve (J) which is obtained by measuring the surface temperature of the fixing roller 2 while the fixing roller 2 at a certain initial reference temperature ($H_O$) is continuously heated by the heating operation of the heater 4, and by calculating the time (T) which is taken for the fixing roller to be heated from the reference temperature to a target temperature on the basis of the heating characteristic curve.

In this embodiment, the scheduled heating time (required warm-up time) of the electric power ($P_W$) during warm-up is prepared and used as the scheduled heating time ($T_X$) in consideration of the difference between heating operations of the heater 4. The required warm-up time ($T_W$) is the time which is required until the fixing roller is heated to a targeted upper limit temperature ($H_W$) during warm-up. Further, when the fixing roller is heated with the electric power during warm-up, the required warm-up time ($T_W$) is the heating time which does not reach the overheat temperature ($T_X$), even when temperature rises due to so-called overshoot after the supply of power to the heater 4 stops. Besides, the scheduled heating time (required standby time) of electric power during standby is prepared and used as the scheduled heating time ($T_X$) of the fixing roller, for example, for every electric power in various modes.

Next, the operation of the fixing device 1A will be described.

First, when a start signal of the fixing operation is input from the main body of the image forming apparatus to which the fixing device is applied, the fixing roller 2 is heated until it reaches a predetermined temperature (for example, the target temperature $H_W$ during the warm-up) by the heating operation of the heater 4 during the warm-up, while the fixing roller 2 begins to be rotationally driven in a predetermined direction. Further, when the fixing roller 2 is heated to a predetermined temperature, the control device 7 then controls the power supply operation to the heater 4 so that the fixing roller 2 is kept in a range of fixing temperature on the basis of the detected information from the temperature sensor 6.

On the other hand, when the fixing roller has been heated to the predetermined temperature, paper P to which a toner image T is transferred, as an object to be fixed, is fed into the fixing nip FN between the fixing roller 2 and the pressure roller 3. Then, the paper P passes trough the fixing nip FN while it is pressure-contacted with the circumferential surface of the fixing roller 2, whereby the toner image T is heated and pressed, and fixed onto the paper. The paper P for which the fixing operation is completed is discharged from the fixing nip FN. If continuous fixing is not performed, the rotational drive of the fixing roller 2 stops at a point of time when predetermined time has lapsed after the fixing operation has been completed.

Further, in the fixing device 1A, when continuous fixing is performed, the above processes are repeated. Moreover, when a start signal of the next fixing operation is not input even when the predetermined time has lapsed after a final fixing operation is completed, the control device 7 becomes a control state in the standby mode. As a result, the fixing roller 2 is heated to be kept at a predetermined temperature (a target temperature during standby) by the heating operation (for example, the heating operation while the level of a voltage supplied to the heater 4 is lowered to be less than that during power-up, and the power supply operation to the heater 4 is controlled on the basis of the detected signal of the temperature sensor 6) of the heater 4 during standby after the control device becomes the control state.

Then, when the paper P is wound around the fixing roller 2, the fixing device 1A operates as follows.

Figure 5:
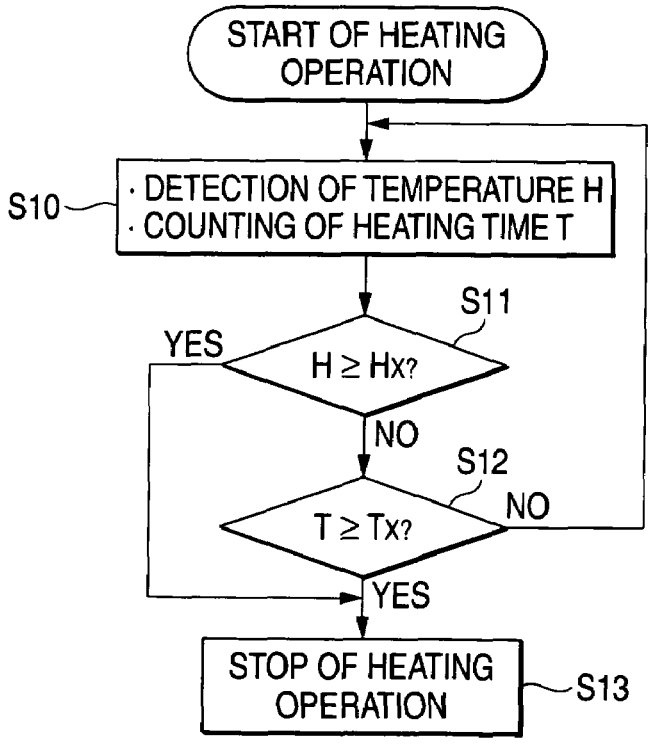
FIG. 5 is a flow chart showing a control operation for preventing the fixing device when paper is wound from being overheated.

Specifically, as shown in FIG. 5, for example, when the heating operation by the heater 4 during power-up is started, the detection of the temperature (H) of the fixing roller 2 by the second temperature sensor 8 and the counting of the continuous heating time (T) of the heater 4 by the timer counter 9 are started (Step 10: S10). The detected information is input to the control device 7 and processed therein.

Thereafter, the control device determines whether the temperature (H) of the fixing roller 2 detected by the temperature sensor 8 becomes more than the overheat temperature ($H_X$) (S11).

At this time, if the detected temperature (H) becomes more than the overheat temperature ($H_X$), paper P is considered to be wound around the fixing roller 2, and the control device 7 stops the power supply operation to the heater 4 from the power unit 5. As a result, the heating operation by the heater 4 is stopped (S13).

Actually, the heating operation stops in such a pattern when the paper P wound around the fixing roller 2 is not the widest paper P1 passing through the widest paper passage region E1, but is the paper P2 passing through the next widest paper passage region E2 or paper narrower than the paper P2.

When such a size of paper P is wound around the fixing roller, the temperature sensor 8 is disposed outside the paper passage region E2. Therefore, the temperature of the circumferential surface of the fixing roller 2 is normally detected with no presence of wound paper. On the other hand, since the temperature sensor 6 at that time is disposed in a region inside the paper passage region E2, the temperature of the fixing roller 2 is detected via the wound paper P. If the detected temperature is a low temperature (a temperature lower than the upper limit of the fixing temperature), the power supply operation by the control which keeps the fixing temperature is not stopped.

Accordingly, in this case, the fixing roller 2 begins to become overheated because it continues to be heated by the heating operation of the heater 4. However, the temperature sensor 8 normally detects the rise in temperature of the fixing roller 2. Therefore, if a finally detected temperature (H) becomes more than the overheat temperature ($H_X$), the control by the control device 7 as mentioned above is performed to stop the heating operation.

Further, if the detected temperature (H) by the temperature sensor 8 reaches the overheat temperature ($H_X$) in Step S1, the control device determines whether or not the continuous heating time (T) counted by the timer counter 9 is more than the required warm-up time ($T_W$) as the scheduled heating time ($T_X$) during warm-up (S12).

At this time, if the continuous heating time (T) does not reach the required warm-up time ($T_W$) as the scheduled heating time ($T_X$), the detection of the temperature (H) by the temperature sensor 8 and the counting of the continuous heating time (T) by the timer counter (S10) are continued, and the determinations in Steps S11 and S12 are repeated, respectively.

On the other hand, if the continuous heating time (T) becomes more than the required warm-up time ($T_W$) in Step S12, paper P is considered to be wound around the fixing roller 2, and the control device 7 stops the power supply operation to the heater 4 from the power unit 5 to thereby stop the heating operation by the heater 4 (S13). In addition, when the heating operation is stopped, the timer counter 9 is reset in any case.

Actually, the heating operation stops in such a pattern when paper wound around the fixing roller 2 is the widest paper P1 passing through the widest paper passage region E1. When such a size of paper P is wound around the fixing roller, since the temperature sensor 8 is disposed inside the widest paper passage region E1, it performs temperature detection via the wound paper P1, which make it impossible to accurately detect the temperature of the circumferential surface of the fixing roller 2. Therefore, the heating operation of the heater 4 is not stopped on the basis of the detection results of the temperature sensor 8 because the detected temperature (H) of the temperature sensor 8 does not become more than the overheat temperature ($H_X$).

Accordingly, in that case, the fixing roller 2 begins to become overheated because it continues to be heated by the heating operation of the heater 4. However, the continuous heating time ($T_W$) of the heater 4 at that time is counted. Therefore, the continuous heating time (T) becomes finally more than required warm-up time ($T_W$), so that the control by the control device 7 as mentioned above is performed to stop the heating operation.

As described above, according to the fixing device 1A, even when paper P is wound around the fixing roller 2 during warm-up, and further even when a situation occurs that the temperature sensor 8 detects the temperature of the fixing roller 2 via the wound paper, the fixing roller 2 is appropriately prevented from being overheated because the heating operation of the heater 4 is normally stopped.

Further, in the fixing device 1A, even when the heating operation during standby is performed, the detection of temperature by the temperature sensor 8 and the counting of the continuous heating time by the timer counter 9 is performed as described above.

As a result, even when paper is wound around the fixing roller 2 during standby, the heating operation of the heater 4 is normally stopped by the control operation of the control device 7 in the same way as the case during warm-up. It is noted herein that this case is different from the above case only in that the scheduled heating time $T_X$ compared with the continuous heating time (T) by the timer counter 9 is changed from the 'required warm-up time $T_W$' to the 'required standby time'.

Accordingly, according to the fixing device 1A, even when paper P is wound around the fixing roller 2 during stand-by, and further even when a situation occurs that the temperature sensor 8 detects the temperature of the fixing roller 2 via the wound paper, the fixing roller 2 is appropriately prevented from being overheated because the heating operation of the heater 4 is normally stopped.

Embodiment 2

Figure 6:
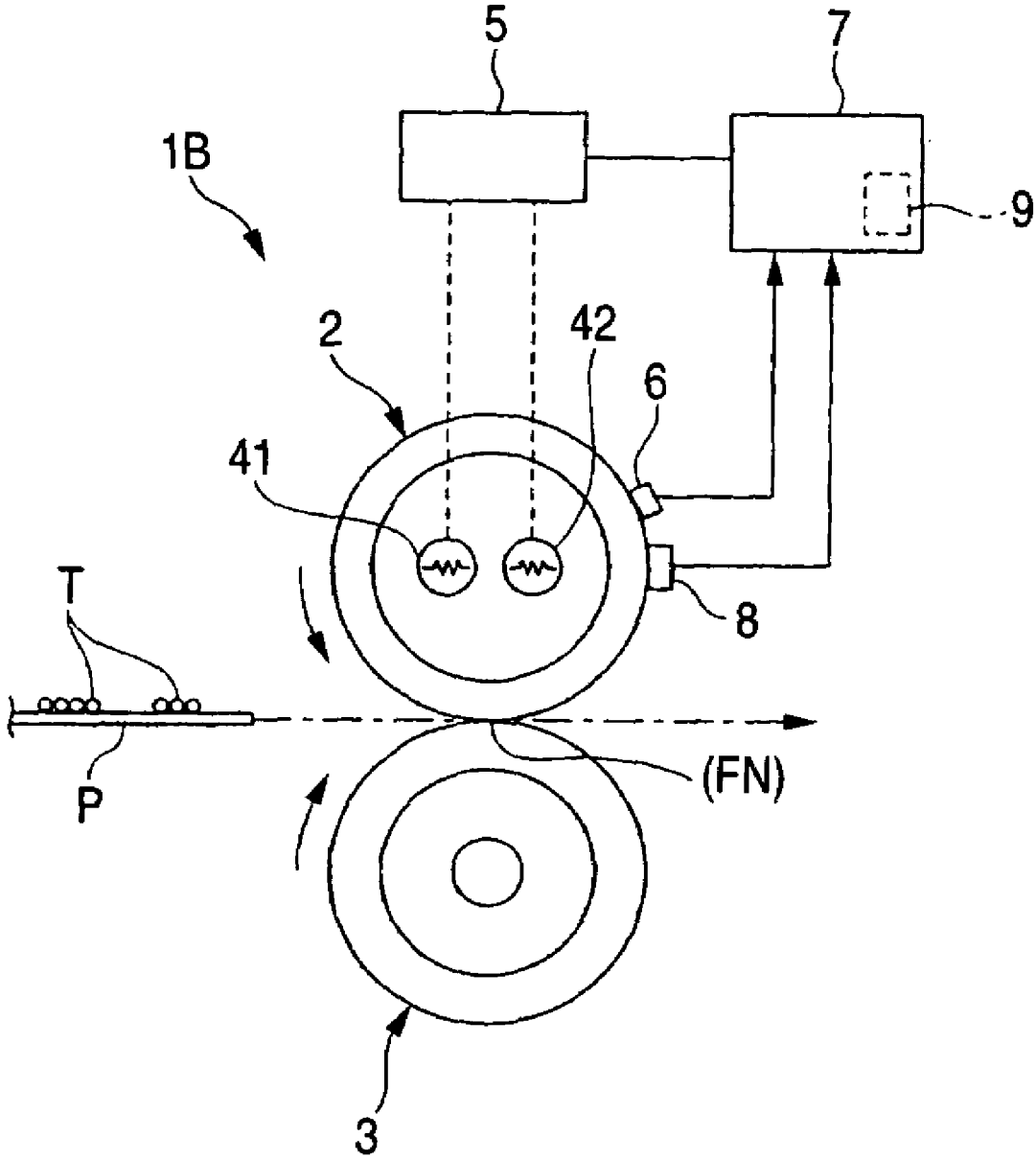
FIG. 6 is a schematic view showing principal parts of a fixing device according to Embodiment 2 of the present invention.
Figure 7:
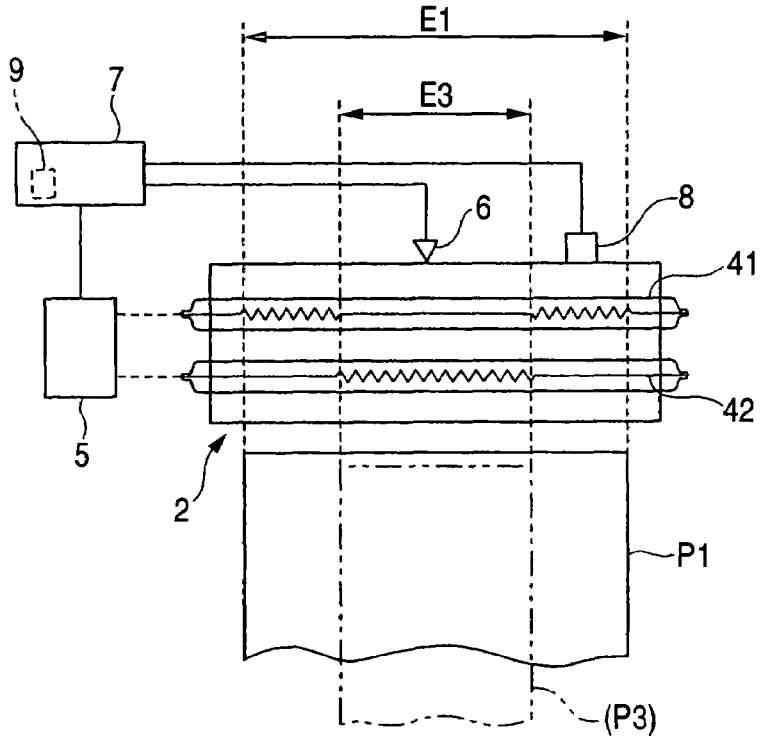
FIG. 7 is an explanatory view showing a construction of a part of the fixing device.

FIGS. 6 and 7 show principal parts of a fixing device according to Embodiment 2 of the present invention, in which FIG. 6 is a schematic view of the fixing device as seen from the front side, and FIG. 7 is an explanatory view of a part of the fixing device.

A fixing device 1B uses two heaters 41 and 42, as a heater which heats the fixing roller 2, each having different widths of heating serving regions, and is configured similar to the fixing device 1A according to Embodiment 1 except that the installation position of the second temperature sensor 8 is set corresponding to the heating serving regions of the plurality of heaters. Accordingly, the same components of the fixing device 1B as those of the fixing device 1A are denoted by the same reference numerals, and the description thereof will be omitted except that there are different contents.

Figure 8:
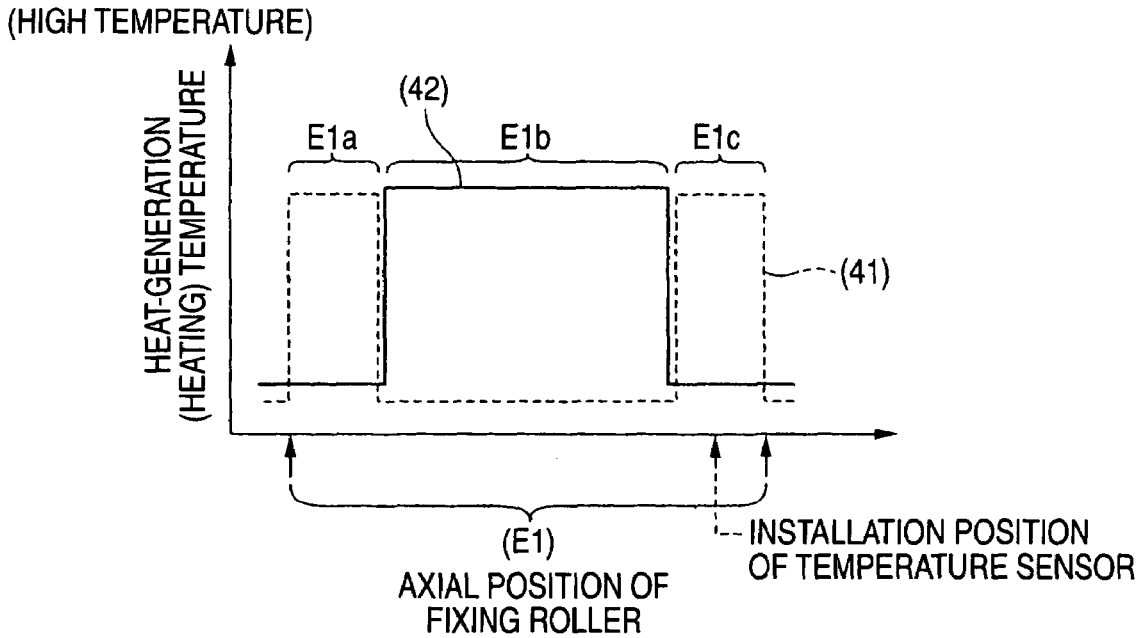
FIG. 8 is a drawing for explaining the relationship between two heating serving regions of a heater.

As shown in FIG. 8, the two heaters 41 and 42 are an electro-thermal heat generation type heater which has heat generating portions capable of serving to heat regions E1*a*, E1*b* and E1*c* obtained by dividing the widest paper passage region E1 into three. Further, the heaters 41 and 42 are separately supplied with predetermined electric power from the power unit 5 to generate heat, thereby individually heating the fixing roller 2 from its hollow interior. In other words, the heaters 41 and 42 are configured such that their heating operation is independently controlled (see FIG. 3).

The heat generating portion of the heater 41 is formed to be able to heat the divided regions E1*a* and E1*c* corresponding to both ends of the widest paper passage region E1. On the other hand, the heat generating portion of the heater 42 is formed to be able to heat the divided region E1*b* (in other words, a region excluding the regions E1*a* and E1*c*) corresponding to the central portion of the widest paper passage region E1.

In particular, the divided region E1*b* at the central portion heated by the heater 42 substantially corresponds to the paper passage region of paper P3 which is narrower than the paper P1 which passes through the entire widest paper passage region E1. As a result, when the fixing of the paper P3 is performed, only the heater 42 is supplied with electric power to generate heat, thereby heating the divided region E1*b* of the fixing roller 2. Further, when the fixing of the paper P1 is performed, in order to heat the entire widest paper passage region E1, both the heaters 41 and 42 are supplied with electric power to generate heat, thereby heating all the divided regions (E1*a*, E1*b* and E1*c*).

Incidentally, as thus described, the two heaters 41 and 42 can heat the entire widest paper passage region E1 at predetermined temperature, and can heat only the partial region (E1*c*) of the widest paper passage region at predetermined temperature. Accordingly, the widest paper passage region E1 can be efficiently heated with heat distribution with no waste. Further, the divided region E1*b* at the central portion may be the same as or different from the paper passage region E2 (see FIG. 2) which is the next widest region to the widest paper passage region E1 in Embodiment 1. In any case, whether the divided region E1*b* is the same as or different from the next widest paper passage region E2 is determined depending on the relationship between the size and use frequency of paper P to be used.

On the other hand, the second temperature sensor 8 is installed to detect the temperature of the circumferential surface within the heating serving region (either E1*a* or E1*c*) including the corresponding end of the heater 41 which heats a region of the widest paper passage region 7 at its endmost side. In Embodiment 2, the temperature sensor 8 is installed at the divided region E1*c* of the two divided regions, but may be installed at the other divided region E1*a*.

Further, the control operation of the control device 7 using the information detected by the temperature sensors 6 and 8 and the timer counter 9 is basically the same as that in Embodiment 1. It is noted herein that, when both the heaters 41 and 42 operate simultaneously, the counting of the continuous heating time (T) of the two heaters 41 and 42 is commonly performed, but when the heating serving region is heated by only the heater 42 at the central portion, only the counting of the continuous heating time (T) of the operating heater 42 is performed. Therefore, a scheduled heating time $T_X$ when only one heater 42 operates alone in addition to the scheduled heating time $T_X$ when both the heaters 41 and 42 are used are separately prepared for the time of the warm-up and the time of standby.

Next, the operation of the fixing device 1B will be described.

First, when a start signal of the fixing operation is input similar to Embodiment 1, the fixing roller 2 is heated until it reaches a predetermined temperature (for example, a target temperature $H_W$ during warm-up) by the heating operation (heating operation that both the heaters 41 and 42 operate simultaneously) of the heaters 41 and 42 during the warm-up, while the fixing roller 2 begins to be rotationally driven in a predetermined direction. Further, if the fixing roller 2 is heated to the predetermined temperature, similar to Embodiment 1, the power supply operation to the heaters 41 and 42 is then controlled by the control device 7 so that the fixing roller 2 is kept at a fixing temperature on the basis of the detected information from the temperature sensor 6, as described above. In addition, at the stage of the fixing roller being kept at the fixing temperature, if the width of paper P as an object to be fixed is narrow, only the heating operation of the heater 42 is performed.

On the other hand, when the fixing roller 2 is heated to the predetermined temperature, paper P to which the toner image T is transferred, as an object to be fixed, is fed into the fixing nip FN between the fixing roller 2 and the pressure roller 3, and fixing is performed similar to Embodiment 1.

Further, in the fixing device 1B, when a start signal of the next fixing operation is not input even when predetermined time has lapsed after a final fixing operation has been completed, the control device 7 becomes a control state in the standby mode. As a result, the fixing roller 2 is heated to be kept at a predetermined temperature (a target temperature during standby) by the heating operation (for example, the heating operation in a condition in which a voltage supplied to the heaters 41 and 42 is changed to a lower voltage than that during power-up) of the heaters during standby after the control device becomes the control state.

Then, when paper P is wound around the fixing roller 2, the fixing device 1B operates as follows.

Specifically, similar to Embodiment 1, as shown in FIG. 5, for example, when the heating operation by the heaters 41 and 42 during power-up is started, the detection of the temperature (H) of the fixing roller 2 by the second temperature sensor 8 and the counting of the continuous heating time (T) of the heaters 41 and 42 by the timer counter 9 are started (Step 10: S10).

Thereafter, the control device determines whether the temperature (H) of the fixing roller 2 detected by the temperature sensor 8 becomes more than the overheat temperature ($H_X$) (S11).

At this time, if the detected temperature (H) becomes more than the overheat temperature ($H_X$), paper P is considered to be wound around the fixing roller 2, and the control device 7 stops the power supply operation to the heaters 41 and 42 from the power unit 5. As a result, the heating operation by the heaters 41 and 42 is stopped (S13).

Actually, the heating operation stops in such a pattern when paper P wound around the fixing roller 2 is not the widest paper P1 passing through the widest paper passage region E1, but is the paper P3 passing through a narrow paper passage region E3 as the heating serving region of the heater 42, or paper narrower than the paper P3. In addition, the heating operation stops in such a pattern when the heating operation of both the heaters 41 and 42 is performed (actually, such a case rarely occurs).

When such a size of paper P is wound around the fixing roller, the temperature sensor 8 is disposed outside the paper passage region E2. Therefore, the temperature of the circumferential surface of the fixing roller 2 is normally detected with no presence of wound paper. On the other hand, if the heater 41 does not operate, but the heating operation of the heater 42 is performed, the divided region E1*c* in which the temperature sensor 8 is installed is not heated. Therefore, the surface temperature of the fixing roller 2 cannot be accurately detected. On the other hand, the situation that the power supply operation is not stopped from the detecting state and detection results of the temperature sensor 6 is the same as that in Embodiment 1.

Accordingly, in this case, the fixing roller 2 begins to become overheated because it continues to be heated by the heating operation of the heaters 41 and 42. However, the temperature sensor 8 normally detects the rise in temperature of the fixing roller 2. Therefore, if the detected temperature (H) becomes finally more than the overheat temperature ($H_X$), the control by the control device 7 as mentioned above is performed to stop the heating operation.

Further, if the detected temperature (H) by the temperature sensor 8 does not reach the overheat temperature (HX) in Step S11, the control device determines whether or not the continuous heating time (T) counted by the timer counter 9 is more than the scheduled heating time TX (the required warm-up time TW) during warm-up (S12).

At this time, if the continuous heating time (T) does not reach the scheduled heating time ($T_X$), similar to Embodiment 1, the detection of the temperature (H) by the temperature sensor 8 and the counting of the continuous heating time (T) by the timer counter (S10) are continued, and the determinations in Steps S11 and S12 are repeated, respectively.

On the other hand, if the continuous heating time (T) becomes more than the continuous heating time $T_X$ ($T_W$) in Step S12, paper P is considered to be wound around the fixing roller 2, and the control device 7 stops the power supply operation to both the heaters 41 and 42 from the power unit 5 to thereby stop the heating operation by the heaters 41 and 42 (S13).

Actually, the heating operation stops in such a pattern when paper wound around the fixing roller 2 is the widest paper P1 passing through the widest paper passage region E1. Besides, the heating operation stops in such a pattern when the paper P wound around the fixing roller 2 is the paper P3 passing through the narrow paper passage region E3, or paper narrower than the paper P3, and when only the heating operation of the heater 42 is performed.

When such a size of paper P1 is wound around the fixing roller, since the temperature sensor 8 is disposed inside the widest paper passage region E1, the temperature sensor performs temperature detection via the wound paper P1, which make it impossible to accurately detect the temperature of the circumferential surface of the fixing roller 2. When the narrow paper P3 (or paper narrower than the paper P3) is wound around the fixing roller and heating is performed by only the heater 42, the divided region E1*c* where the temperature sensor 8 is installed is not heated (the heating by the heater 41 is not performed), which makes it further impossible to perform accurate detection of temperature. Thus, since the detected temperature (H) of the temperature sensor 8 does not become more than the overheat temperature (HX), the heating operation of the heater 42 is not stopped on the basis of the detection results of the temperature sensor 8.

Accordingly, in this case, a part (the divided region E1*b*) of the fixing roller 2 begins to become overheated because it continues to be heated by the heater 42. However, the continuous heating time (T) of the heater 42 at that time is counted. Therefore, if the continuous heating time (T) becomes finally more than the scheduled heating time TX (TW), the control by the control device 7 as mentioned above is performed to stop the heating operation.

As described above, according to the fixing device 1B, even when paper P is wound around the fixing roller 2 during warm-up, and further even when a situation occurs that the temperature sensor 8 detects the temperature of the fixing roller 2 via the wound paper, the fixing roller 2 is appropriately prevented from being overheated because the heating operation of both the heaters 41 and 42 or the heater 42 is normally stopped.

Further, in the fixing device 1B, even when the heating operation during standby is performed, the detection of temperature by the temperature sensor 8 and the counting of the continuous heating time by the timer counter 9 is performed as described above.

As a result, even when paper is wound around the fixing roller 2 during standby, the heating operation of the heaters 41 and 42 is normally stopped by the control operation of the control device 7 in the same way as the case during warm-up. It is noted herein that this case is different from the above case only in that the scheduled heating time $T_X$ compared with the continuous heating time (T) by the timer counter 9 is changed from the 'required warm-up time $T_W$' to the 'required standby time', similar to Embodiment 1.

Accordingly, according to the fixing device 1B, even when paper P is wound around the fixing roller 2 during standby, and further even when a situation occurs that the temperature sensor 8 detects the temperature of the fixing roller 2 via the wound paper, the fixing roller 2 is appropriately prevented from being overheated because the heating operation of both the heaters 41 and 42 is normally stopped.

Other Embodiment

Although the fixing devices in which the fixing roller 2 and the pressure roller 3 are used are exemplified in Embodiments 1 and 2 as the fixing devices 1A and 1B, a fixing device in which any one or both of the fixing roller and the pressure roller is/are substituted with a belt-type rotary heating body or rotary pressure body may be employed, if necessary. In this case, the temperature sensors 6 and 8 can be installed in contact with an outer circumferential surface of the belt-type rotary heating/pressure body, or may be installed to contact the surface of a heating roller which heats the belt-type rotary heating/pressure body or the surface of a backup roller disposed in the fixing nip.

Further, if necessary, in the fixing device 1A according to Embodiment 1, the information detected by the second temperature sensor 8 may be used for controlling the fixing temperature without providing the temperature sensor 6. Further, in the fixing device according to Embodiment 2, the number of the heaters may be at least three, or the divided regions of the widest paper passage region E1 may be subdivided into at least four regions. Further, although the fixing device in which the heating serving regions (E1*a*, E1*b* and E1*c*) of the plurality of heaters (41 and 42) are divided in good order so as not to overlap each other is exemplified in Embodiment 2, the divided regions of each heater may be overlapped with each other as long as they have widths different from each other.

What is claimed is:

1. A fixing device comprising:

a heater;

a fixing rotary body having a circumferential surface which paper carrying an unfixed image makes contacts with and passes on, and heated to a predetermined temperature by a heating operation of the heater;

a temperature detecting unit which detects the temperature of a portion of the circumferential surface inside a widest paper passage region in an axial direction of the fixing rotary body;

a control unit which stops the heating operation of the heater when a temperature detected by the temperature detecting unit exceeds a predetermined overheat temperature; and a measuring unit which measures a continuous heating time, in which the heating operation of the heater continues, from a point of time when the heating operation of the heater starts, wherein the control unit stops the heating operation of the heater when the continuous heating time measured by the measuring unit exceeds a predetermined scheduled heating time.

2. A fixing device comprising:

a heater;

a fixing rotary body having a circumferential surface which paper carrying an unfixed image makes contacts with and passes on, and heated to a predetermined temperature by a heating operation of the heater;

a temperature detecting unit which detects the temperature of a portion of the circumferential surface inside a widest paper passage region in an axial direction of the fixing rotary body;

a control unit which stops the heating operation of the heater when a temperature detected by the temperature detecting unit exceeds a predetermined overheat temperature; and a measuring unit which measures a continuous heating time from a point of time when the heating operation of the heater starts, wherein the control unit stops the heating operation of the heater when the continuous heating time measured by the measuring unit exceeds a predetermined scheduled heating time;

wherein the temperature detecting unit is disposed to detect a temperature of a portion of the circumferential surface outside a paper passage region which is narrower than the widest paper passage region.

3. A fixing device comprising:

a heater;

a fixing rotary body having a circumferential surface which paper carrying an unfixed image makes contacts with and passes on, and heated to a predetermined temperature by a heating operation of the heater;

a temperature detecting unit which detects the temperature of a portion of the circumferential surface inside a widest paper passage region in an axial direction of the fixing rotary body;

a control unit which stops the heating operation of the heater when a temperature detected by the temperature detecting unit exceeds a predetermined overheat temperature;

a measuring unit which measures a continuous heating time from a point of time when the heating operation of the heater starts, wherein the control unit stops the heating operation of the heater when the continuous heating time measured by the measuring unit exceeds a predetermined scheduled heating time; and a plurality of heaters having different widths of heating serving regions within the widest paper passage region and having their heating operation independently controlled, wherein the temperature detecting unit is disposed to detect a temperature of a circumferential surface of the heating serving region including an end of the heater which heats a region of an endmost side of the widest paper passage region.

4. The fixing device according to claim 1, wherein the control unit employs a required warm-up time as a scheduled heating time when the heating operation of the heater is an operation during warm-up, and employs a required standby time as a scheduled heating time when the heating operation of the heater is an operation during standby.

* * * * *